United States Patent [19]

Zarwell

[11] Patent Number: 4,984,403

[45] Date of Patent: Jan. 15, 1991

[54] MODULAR BUILDING BLOCK

[76] Inventor: Daniel W. Zarwell, 1296 N. 64th St., Wauwatosa, Wis. 53213

[21] Appl. No.: 426,920

[22] Filed: Oct. 25, 1989

[51] Int. Cl.[5] ..... E06B 3/64

[52] U.S. Cl. ..... 52/476; 52/788

[58] Field of Search ..... 52/788, 790, 306, 307, 52/308, 476

[56] References Cited

U.S. PATENT DOCUMENTS

| | | | |
|---|---|---|---|
| 3,024,880 | 3/1962 | Burmeister | 52/788 X |
| 3,252,260 | 5/1966 | Mills | 52/788 |
| 3,373,538 | 3/1968 | Praga | 52/403 |
| 3,925,950 | 12/1975 | von der Ley | 52/307 X |
| 4,459,789 | 7/1984 | Ford | 52/788 X |
| 4,628,652 | 12/1986 | Wefels | 52/306 |

FOREIGN PATENT DOCUMENTS

| | | | |
|---|---|---|---|
| 878093 | 6/1953 | Fed. Rep. of Germany | 52/788 |

*Primary Examiner*—John E. Murtagh

*Attorney, Agent, or Firm*—Quarles & Brady

[57] ABSTRACT

A modular building block wherein a plurality of frame members sandwich fit panels therebetween so as to provide a block with a selective depth and insulation factors. The modular block can be interconnected with other similar blocks to provide any desired structure such as a window, wall or floor. The block is easily assembled yet can be repaired as the frame members can be disassembled and old panels replaced with new ones.

11 Claims, 3 Drawing Sheets

FIG 1
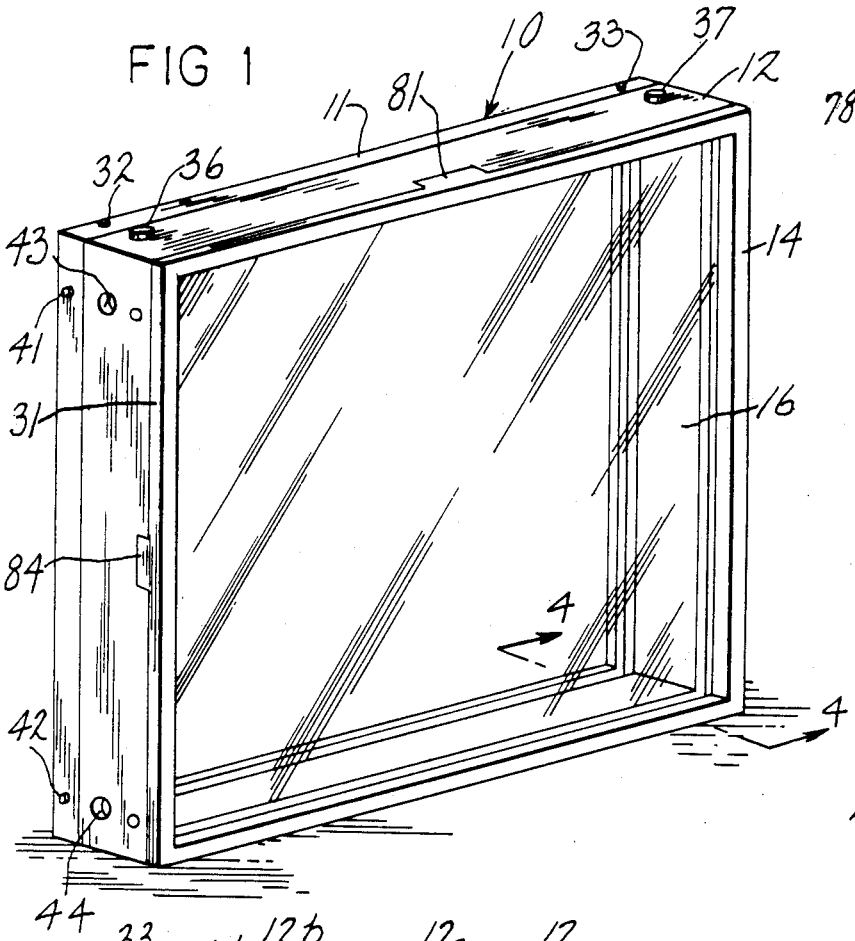
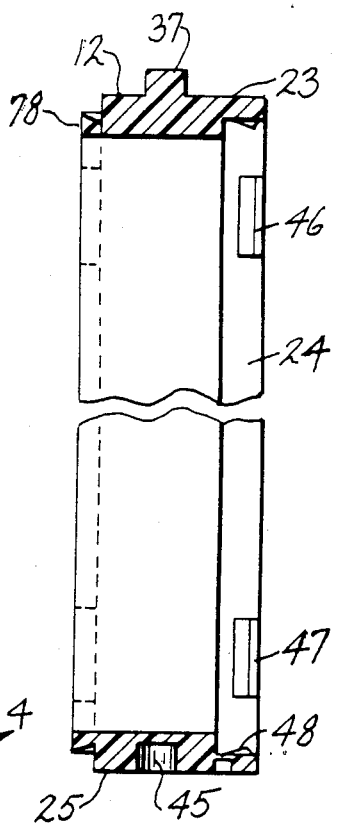
FIG. 3
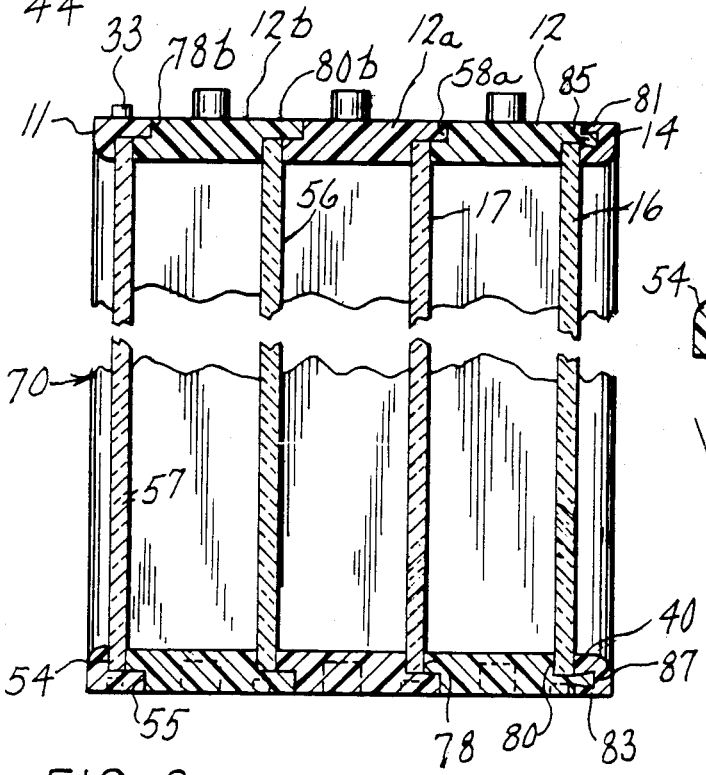
FIG. 6
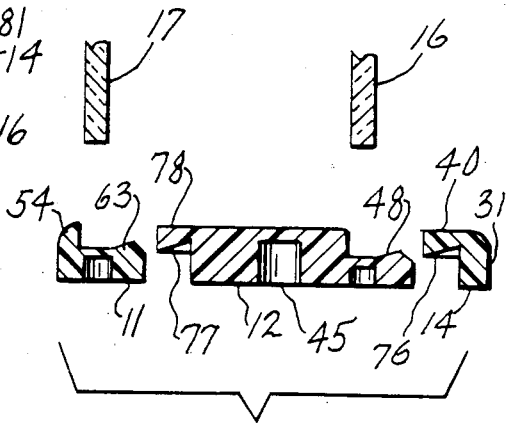
FIG. 4

MODULAR BUILDING BLOCK

BACKGROUND OF THE INVENTION

This invention relates to a building block and more particularly to a modular building block which can be used for constructing various structures such as windows, walls, floors, etc.

In U.S. Pat. No. 3,024,880 there is shown a building panel unit which is constructed of an outer frame 13 with an inner gridwork provided by innerlocking longitudinal and transverse beams 10 and 11. Two sheets 12 of translucent material such as plastic are supported by the gridwork and the frame. In U.S. Pat. No. 3,252,260 lightweight plastic panels 22 and 24 are disclosed. These are assembled together by means of vertical and horizontal inside and outside rectangular bars 60 and 62 which engage outer lateral flanges 40 and 42 of the panels. These bars also provide for connection with additional panel units. Glass panels are described for structural elements in U.S. Pat. Nos. 3,373,538 and 4,628,652. In the '538 patent the glass panels are interconnected by elastic connectors 6 whereas in the '652 patent, glass bodies 1*a* and 1 *b* are interconnected by a hard integral foam frame 3.

The prior art does not provide a building block unit which has the versatility of customizing the block for various needs such as insulation properties. Neither does the prior art provide a building block structure wherein the average person can assemble it and put it in place with the use of common tools and materials. The prior art is also deficient in affording a building block of the foregoing type which is modular so that individual units can be easily secured to each other.

It is an object of the invention to provide a building block which can be assembled in a manner to provide a wide variety of insulation capabilities.

It is another object of this invention to provide a building block which can be easily installed.

It is yet another object of the invention to provide a building block of the foregoing type which is modular and can be easily interconnected with other units of the same type.

It is still another object of the invention to provide a building block of the foregoing type which can be easily repaired.

It is an additional object of the invention to provide a modular building block which can be easily assembled either by hand or with automated equipment.

Other objects include a building block which has the versatility for use in constructing a wall, ceiling, floor or window, as well as can be fabricated and repaired with waste material such as scrap glass or plastic.

SUMMARY OF THE INVENTION

The foregoing objects are accomplished and the disadvantages of the prior art are overcome by the present modular building block which includes a first frame member having walls for supporting a first panel member and an inwardly extending surface to prevent passage of the panel member through the first frame member. A second frame member has a projecting wall member constructed and arranged to fit within the first frame member and hold the first panel between the projecting wall member and the inwardly extending surface. The second frame member also has walls for supporting a second panel member and an inwardly extending wall surface to prevent passage of the second panel member through the second frame member. There is also a third frame member having a projecting wall constructed and arranged to fit within the second frame member and hold the second panel between the projecting wall of the third frame and the inwardly extending surface of the second frame. Frictional engagement means are operatively associated with the frame members to hold them together with the panel members sandwiched therebetween.

In a preferred embodiment, the modular block is connected to a second modular block with means operatively associated with the blocks for interconnection.

In one aspect of the invention the second frame member provides a common and multiple frame member for use in constructing a modular block. The projecting wall member of the second frame member is constructed and arranged to fit within the previously described first frame and hold a first panel between the projecting wall member and the first frame. The second frame member is constructed and arranged to receive an additional second frame member opposite the first frame and to hold a second panel member between the two second frame members. Any number of second additional frame members can be interconnected with the outermost second frame member connected to previously described third frame member.

BRIEF DESCRIPTION OF DRAWINGS

FIG. 1 is a front perspective view of the modular building block of this invention.

FIG. 3 is a view in vertical section of one of the frame members composing the building block of FIG. 1.

FIG. 4 is a view taken along line 4—4 of FIG. 1 but showing the frame members and the panels separated.

FIG. 6 is a view taken along line 6—6 of FIG. 5.

DESCRIPTION OF THE PREFERRED EMBODIMENTS

Figure 2:
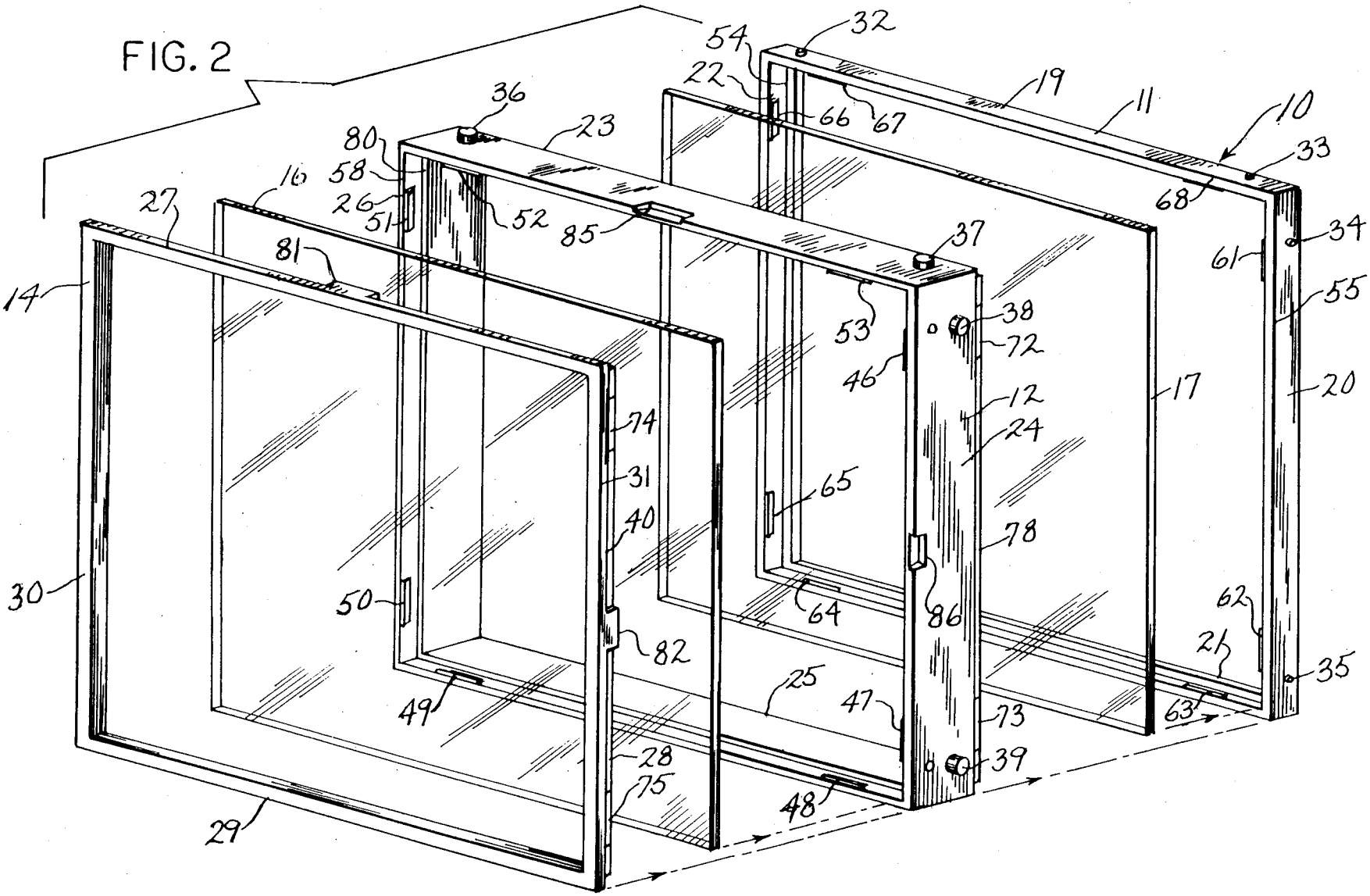
FIG. 2 is an assembly view of the modular building block as shown in FIG. 1.

Referring to FIGS. 1 and 2 the modular building block is shown generally at 10 and represents a basic unit structure. It includes a three frame unit with frame member 11 on one side, frame member 12 in the center, and frame member 14 at the other side. These three frame members hold in a sandwich-like effect, two panel members 16 and 17 as best seen in FIG. 2. All three frame members have basically the same geometric configuration and are square in cross section. Frame member 11 includes four wall portions 19–22. The wall portions of frame member 12 are represented by the numerals 23–26, and the wall portions of frame member 14 by the numerals 27–30. Peg-like projecting members 32, 33, 34 and 35 extend from wall portions 19 and 20 of frame member 11 and peg-like members 36, 37, 38 and 39 extend from the wall members 23 and 24 of frame member 12. The purpose of these peg members is to provide a frictional attachment with other modular units such as by fitting into the openings 41 and 42 of a similar frame member 11 and 43 and 44 of a similar frame member 12. It will be recognized that peg members 32, 33, and 36 and 37 will fit into accommodating openings in the bottom of a corresponding frame member such as indicated at 45 in FIG. 3 when another modular block would be placed on top of the block 10 shown in FIG. 1.

An important feature of this invention is the manner in which the frame members 11, 12 and 14 interfit with the panels 16 and 17 therebetween. Referring specifically to FIG. 2 it is seen that there are the projections 46–53 extending from the inside of the wall members 23–26 of frame member 12. These are designed so as to fit in corresponding undercut portions such as 74 and 75 in the frame member 14. These projections, as are the undercuts, are located so as to have maximum engagement when the panel member 16 rests against the inwardly extending wall 80 of the frame member 12 and the inset portion 40 of the frame member 14 presses against the panel 16 while the outer portion 31 of frame member 14 engages the frame 12. This is best seen in conjunction with FIGS. 2 and 4.

In a somewhat similar manner, the panel 17 is retained between frame members 11 and 12. There are the projections 61–68 for fitment into the undercuts such as 72 and 73 in the frame member 12. In this instance there is a projecting wall 78 extending from the frame member 12 for fitment inside the frame member 11 and against the panel 17 so as to sandwich fit the panel between the two frames. The panel 17 is thereby held between the projecting wall 78 and the inset portion 54 extending from the wall members 23–26 of the frame member 11. This is also shown in detail in FIGS. 2 and 4.

The innerfitment between the projections and the indentations on the various frame members is shown in detail in FIG. 4. There it will be seen that the projection 63 on the frame member 11 fits within the undercut 77 in the frame member 12 whereas the projection 48 on the frame member 12 fits within the undercut 76 on the frame member 14. If desired, additional latching can be effected between frame members 14 and 12 such as by the projections 81–84 disposed in the frame members 14 and the undercut members 85–87 on the frame member 12. This is best seen in conjunction with FIGS. 2 and 6.

In the description herein it should be understood that similar components of the described modular blocks are designated by the same number except followed with different letters.

Figure 5:
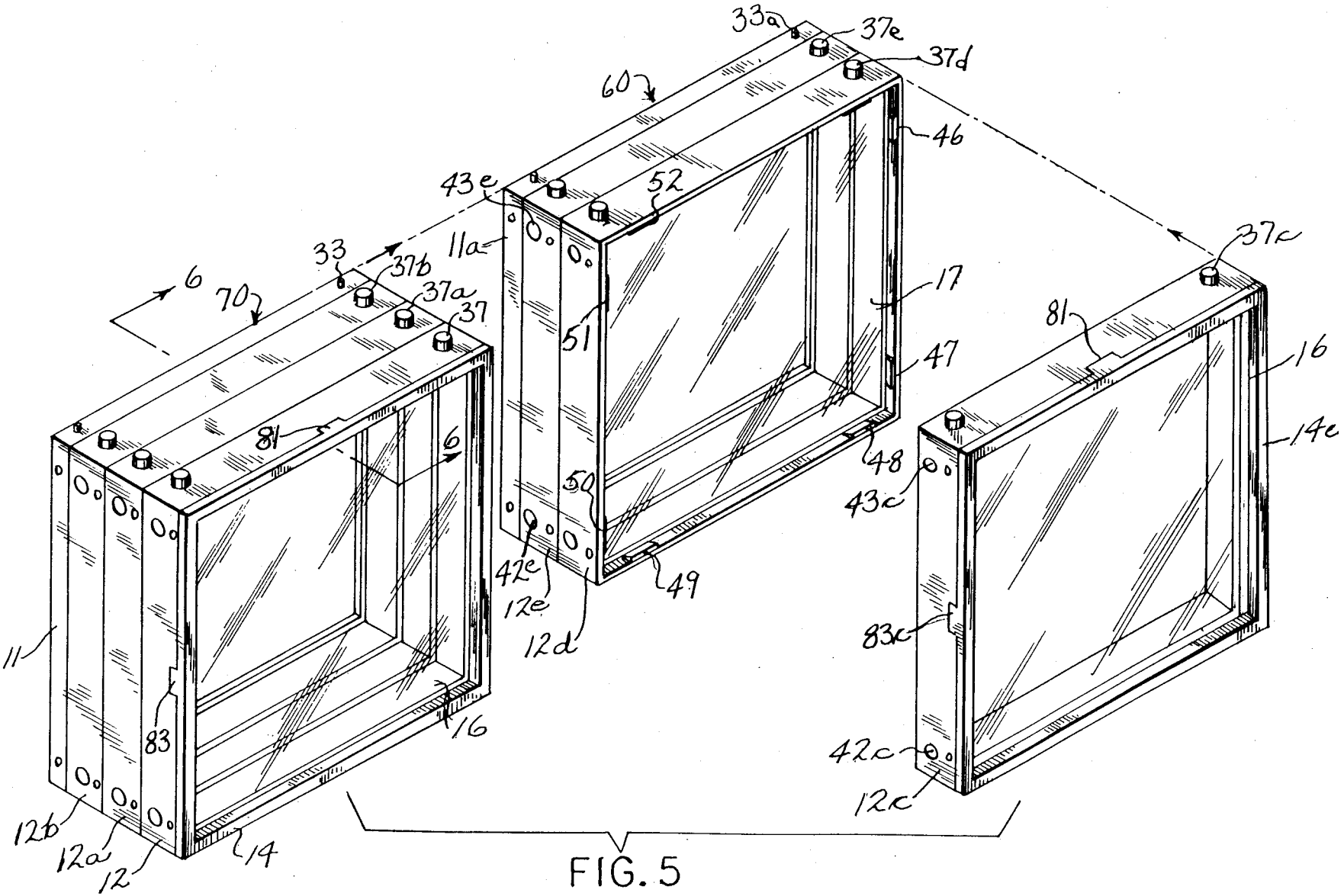
FIG. 5 is a perspective and assembly view of the modular building block illustrating the interconnection of several frame members to form a modular unit as well as the interconnection of the units.

The versatility and modularity of the modular block is exemplified with respect to FIGS. 5 and 6. There it will be seen that several of the frame members such as 12, **12*a*, and 12*b* have been interconnected so as to afford placement of several panel members such as 16, 17, 56 and 57 in between to result in a modular unit generally 70. This versatility to sandwich fit a multiplicity of panels is afforded by the frame member 12 which is specifically FIG. 3, and its interconnection with similar frame members 12*a* and *b* as shown in FIG. 6. It is seen that frame member 12 not only can receive the frame member 14 on one side, but also can interconnect with a similar frame such as shown as 12*a* at the opposite side by interfitment of the projecting wall 78 within the frame such as 12*a* which is afforded by the overhang portion 58*a* on the frame member 12*a*. Interlocking would be afforded such as by the undercuts indicated at 72, 73 and 77 on frame member 12, engaging projections 46–53 which would be disposed on frame member 12*a*. In a similar manner, frame member 12*a* interfits with frame 12*b*. Frame 11 is accommodated on frame member 12*b* in the manner previously described in conjunction with frame members 11 and 12 of modular block 10 as shown in FIG. 2**.

As also seen in FIG. 5, the modular block unit 70 with the panel members 12, **12*a*, and 12*b* can be positioned to laterally fit into the panel members 12*c*, 12*d*, and 12*e* of the modular block unit generally 60 by means of the lateral projections such as 38 and 39 (See FIG. 2) for fitment into the lateral openings such as 43*c*, 42*c* and 43*e* 42*e* in the frame members 12*c* and 12*e*. It is obvious that not only will the frame members fit together in a lateral manner, but they will also fit together one above the other by means of the upwardly projections such as 37 and 37*a–e* for fitment into openings in the bottom of similar frame members such as indicated at 45 in FIG. 3**.

While not shown in the drawings, adjacent frame members 14 and **14*c* could be interconnected with the previously described peg and opening arrangement such as shown by the pegs 34 and 35 and the openings 41 and 42 of the frame member 11**.

An important feature of this invention is the fact that any number of spaced panels can be employed in a single modular unit. It is well recognized that air is a very good insulator and the more dead air space created between the spaced panels the better the insulation factor. This is provided by the modular block design as seen in FIG. 6.

It will be appreciated that while the previously described interfitment of the various frame members provides a tight seal for the panels in the frame members, if desired, silicone calking material or similar type calking material can be suitably employed. For example it could be placed over the outer surface of the panel 16 adjacent the walls 27–30 as well as inside the frame members and against the adjacent panel surfaces such as over the inset portion 54 of frame member 11 and the inwardly extending wall 80 of frame member 12. In this manner, not only is a tight seal provided, but also repair becomes quite convenient as the frame members can be separated and the panels removed by merely scraping away the calking compound which remains in a semi-solid manner. For a more secure frame structure adhesive could be placed between the frame members.

The frame members of this invention are composed of a polyvinylchloride plastic material available from the B.F. Goodrich Company as No. 85856 or 85890. However, other suitable plastics can be used such as those which are easily injection molded. It will be obvious that any type of panel member can be utilized in conjunction with this invention whether clear glass, plastic, or colored glass or plastic depending on the type of structure desired. A very versatile as well as artistic effect is afforded.

The use of the plastic frame members herein not only afford a snap fitment arrangement which permits disassembly for repair but a construction which is lightweight thus reducing shipping costs. It also permits hand or machine assembly.

The foregoing invention can now be practiced by those skilled in the art. Such skilled persons will know that the invention is not necessarily restricted to the particular embodiments presented herein. The scope of the invention is to be defined by terms of the following claims as given meaning by the preceding description.

I claim:

1. A modular building block comprising:

a first frame member having walls for supporting a first panel member and an inwardly extending surface to prevent passage of said panel member through said first frame member;

a second frame member having a projecting wall member constructed and arranged to fit within said first frame member and hold said first panel between said projecting wall member and said inwardly extending surface, said second frame member including walls for supporting a second panel member and an inwardly extending wall surface to prevent passage of said second panel member through said second frame member;

a third frame member having a projecting wall constructed and arranged to fit within said second frame member and hold said second panel between said projecting wall of said third frame and said inwardly extending surface of said second frame; and frictional engagement means operatively associated with said frame members to provide frictional engagement between said frame members for holding said frame members in an assembled manner.

2. The modular block as defined in claim 1 further including a second modular block and means operatively associated with said blocks for interconnection.

3. The modular block as defined in claim 2 wherein said frame members are rectangular, said means for interconnection are peg and hole members with said pegs positioned on two sides of said frames and the holes positioned on the remaining two sides.

4. The modular block as defined in claim 1 wherein said inner surface of said second frame and said projecting wall member are defined by a continuous wall surface.

5. The modular block as defined in claim 1 wherein said panel is glass.

6. The modular block as defined in claim 1 wherein said frames are composed of a plastic material.

7. A modular building block comprising:

a first frame member including walls for supporting a first panel and an inwardly extending surface to prevent passage of said panel member through said first frame member;

a second frame member having a projecting wall member constructed and arrange to fit within said first frame member and hold said first panel between said projecting wall member and said inwardly extending surface, said second frame member including walls for supporting a second panel and an inwardly extending wall surface to prevent passage of said second panel member through said second frame member;

at least one additional second frame member having a portion adapted to fit within said second frame member;

a third frame member having a projecting wall constructed and arranged to fit within one of said additional second frame member and hold said second panel between said projecting wall of said third frame and said inwardly extending surface of said second frame member; and frictional engagement means operatively associated with said frame members to provide frictional engagement between said frame members for holding said frame members in an assembled manner.

8. The modular block as defined in claim 7 wherein a plurality of said additional second frame members with panel members therein are interconnected to each other with one outermost second frame having said first frame member connected thereto and another outermost second frame having said third frame member connected thereto.

9. The modular block as defined in claim 8 wherein at least some of said frame members have means operatively associated therewith for connection with said other frame members of other blocks.

10. The modular block as defined in claim 9 wherein said means for connection of said frame members is frictional engagement means.

11. A modular building block comprising:

first, second and third frame members, said frame members constructed and arranged to retain a first and a second panel member between said first and third frame members with said first and second panel members located in a spaced manner with respect to each other and said second frame member; and frictional engagement means operatively associated with said frame members to provide frictional engagement between said first frame member and said second frame member and said third frame member and said second frame member for holding said frame members in an assembled manner with said panel members therebetween.

* * * * *